United States Patent [19]

Kondo

[11] Patent Number: 4,657,420

[45] Date of Patent: Apr. 14, 1987

[54] PAPER FEED MECHANISM

[75] Inventor: Hiroatsu Kondo, Zushi, Japan

[73] Assignee: Canon Kabushiki Kaisha, Tokyo, Japan

[21] Appl. No.: 650,853

[22] Filed: Sep. 14, 1984

[30] Foreign Application Priority Data

Sep. 20, 1983 [JP] Japan ..... 58-172284

[51] Int. Cl.[4] ..... B41J 11/58; B41J 13/042

[52] U.S. Cl. ..... 400/625; 400/636.2; 400/638; 400/639.1

[58] Field of Search ..... 400/625, 636.2, 638, 400/639, 639.1, 639.2, 636, 636.1

[56] References Cited

U.S. PATENT DOCUMENTS

| | | | |
|---|---|---|---|
| 1,973,589 | 9/1934 | Watson | 400/636.1 |
| 4,262,894 | 4/1981 | Marano | 400/625 X |
| 4,275,969 | 6/1981 | Matsuhisa | 400/639.1 X |
| 4,396,307 | 8/1983 | Shah et al. | 400/625 |
| 4,523,869 | 6/1985 | Martin | 400/636.2 X |

FOREIGN PATENT DOCUMENTS

| | | | |
|---|---|---|---|
| 344431 | 3/1960 | Switzerland | 400/639.1 |
| 17654 | of 1904 | United Kingdom | 400/639 |

*Primary Examiner*—Edgar S. Burr
*Assistant Examiner*—James R. McDaniel
*Attorney, Agent, or Firm*—Fitzpatrick, Cella, Harper & Scinto

[57] ABSTRACT

A paper feed mechanism comprises first and second rotating members rotated by a drive source, and pressing means swingable in a first direction to contact to and separate from the first rotating member and movable in a second direction crossing to the first direction to contact to and separate from the second rotating member. The pressing member selectively presses the first rotating member or the second rotating member to feed a record paper.

5 Claims, 8 Drawing Figures

PAPER FEED MECHANISM

BACKGROUND OF THE INVENTION

1. Field of the Invention

The present invention relates to a paper feed mechanism ina recorder which forms a record on a record paper being fed.

2. Description of the Prior Art

A prior art recorder of this type has a paper pressing mechanism called a paper bail having a paper pressing roller for pressing a record paper which is fed along a platen.

If only a paper feed roller which is rotated in contact with the platen is provided the movement of the record paper would be unstable or the record paper would slightly float from the platen and noises are generated when the record paper is impacted. The paper pressing mechanism is provided to prevent such problems.

In the paper pressing mechanism called the paper bail, the roller is urged to the platen in a normal condition, and it is moved off the platen by a manipulation of an operator when the record paper is loaded and again urged to the platen after the record apper has been loaded.

An example of the recorder of such a structure is shown in FIGS. 1–4. Numeral 1 denotes a platen to a shaft 1*a* of which a pulley 2 is fixed.

A belt 3 spans between the pulley 2 and a pulley 5 which is mounted on a paper feed motor 4.

A paper feed roller 8 contacts the platen 1 which is a rotating paper feed member, and a record paper 6 is fed through a space between the platen 1 and the paper feed roller 8. Numeral 9 denotes a paper bail which is a paper pressing member for pressing the record paper to the platen 1. It has left and right arms 7*a* which are holding members, and pinch rollers 7 are rotatably held on a shaft 7*b* which extends between the arms 7*a*.

The record paper 6 is guided along the platen 1, passes through a record position 6a and is pressed by the rollers 7.

Intermediate portions of the arms 7*a* are pivotably supported by a shaft 11 to a frame 10 of the recorder, and lower ends of the arms 7*a* are linked to ends of levers 15 by a shaft 7*c*.

Spring 17 spans between the other ends of the levers 15 and the frame 10 so that a clockwise rotating force is imparted to the lever 15.

Numeral 13 denotes a release lever for actuating the paper bail. An intermediate portion therof is pivotably supported by a shaft 14 to the frame 10.

A pin 16 projects from a lower end of the release lever 13 and fits into a notch 15*a* formed below a free end of the lever 15.

A torsion coil spring 12 which functions as an overcenter spring spans between a projection formed near a bearing of the arm 7*a* and the frame 10.

In the recorder thus constructed, the release lever 13 is rotated clockwise as shown in FIG. 3 and the lever 15 is pushed leftward. Accordingly, the arm 7*a* is rotated clockwise around the shaft 11 and the roller 7 pushes the platen 1.

On the other hand, in the release mode, the release lever 13 is rotated counterclockwise as shown in FIG. 4, the lever 15 is pulled rightward through the pin 16 and the arm 7*a* is moved off the platen 1. Accordingly, the roller 7 is moved off the platen 1.

Under this condition, the torsion coil spring 12 is beyond its deadpoint and the lower end of the arm 7*a* holds the arm 7*a* at a position in contact with a stopper 10*a* projecting from a side of a frame 10.

By manipulating the release lever 13, the contact and the separation of the platen and the roller are attained.

As various types of recorders are designed, a so-called cut sheet feeder which is detachable from the recorder and automatically feeds and ejects a record paper is used.

FIG. 5 shows a recorder having such a cut sheet feeder mounted. Numeral 18 denotes a paper stacker of the cut sheet feeder which accommodates a number of record papers and is urged to a paper feed roller 20 made of rubber by a spring 19 through the record paper.

The paper feed roller 20 is rotated by a separate drive source 9 (not shown) to feed the record papers, one at a time, to the platen 1 through a space between paper guides 21 and 22.

The record paper fed out of the paper guides 21 and 22 is fed to a space between the platen 1 and the paper feed roller 8 which normally contacts the platen 1 and fed in a print direction.

A gear 1*a* is fixed to the shaft 1*a* of the platen 1 and rotated by a drive source (not shown). A gear 23 which is a motive force transmission member meshes with the gear 1*a*, and a gear 24 meshes with the gear 23, a paper ejection roller 25 which is a rotating member is fixed to a shaft of the gear 24, and a pinch roller 26 contacts the roller 25. Numeral 27 denotes a paper guide which is in union with an ejection stacker 28 which accommodates the record papers fed out of the platen 1.

The record paper 6 is fed into the ejection stacker 28 through a space between the paper ejection roller 25 and the pinch roller 26 which is urged to the roller 26 by a spring (not shown).

The feed amount by the paper ejection roller 25 and the feed amount by the platen 1 are set to be equal and the roller 25 and the platen 1 are rotated synchronously.

When the cut sheet feeder of this structure is mounted, the following disadvantage is encountered.

The automatically fed record paper may jam if the paper bail 9 contacts the platen 1 in the apparatus having the cut sheet feeder mounted thereon. Accordingly, the paper bail 9 is released when the cut sheet feeder is used, and the rollers 25 and 26 take the place of the rollers of the paper bail 9.

However, when the paper bail 9 is in the released position, the rollers 7 of the paper bail block a view field of an operator so that the operator cannot watch the record position.

SUMMARY OF THE INVENTION

It is an object of the present invention to provide a paper feed mechanism suitable for a recorder.

It is another object of the present invention to provide a paper feed mechanism which shares parts to simplify the construction.

It is another object of the present invention to provide a cut sheet feeder which allows an operator to readily watch a record position when the cut sheet feeder is mounted on a recorder.

It is another object of the present invention to provide a cut sheet feeder which is suitably mounted on a recorder.

It is another object of the present invention to provide a recorder suitable to mount a cut sheet feeder.

The other objects will be apparent from the following description of the invention.

BRIEF DESCRIPTION OF THE DRAWINGS

FIGS. 1 to 5 shows structures of a prior art apparatus in which,

FIG. 1 is a perspective view of a platen,

FIG. 2 is a side elevational view of the platen,

FIGS. 3 and 4 are side elevational views for illustrating an operation,

FIG. 5 shows a cut sheet feeder mounted on the apparatus,

FIGS. 6 to 8 show one embodiment of the present invention in which,

FIG. 6 is a side elevational view of a cut sheet feeder in a set position,

FIG. 7 is a side elevational view of a paper bail, and

FIG. 8 is a sectional view of a paper bail.

DETAILED DESCRIPTION OF THE PREFERRED EMBODIMENT

Figure 1:
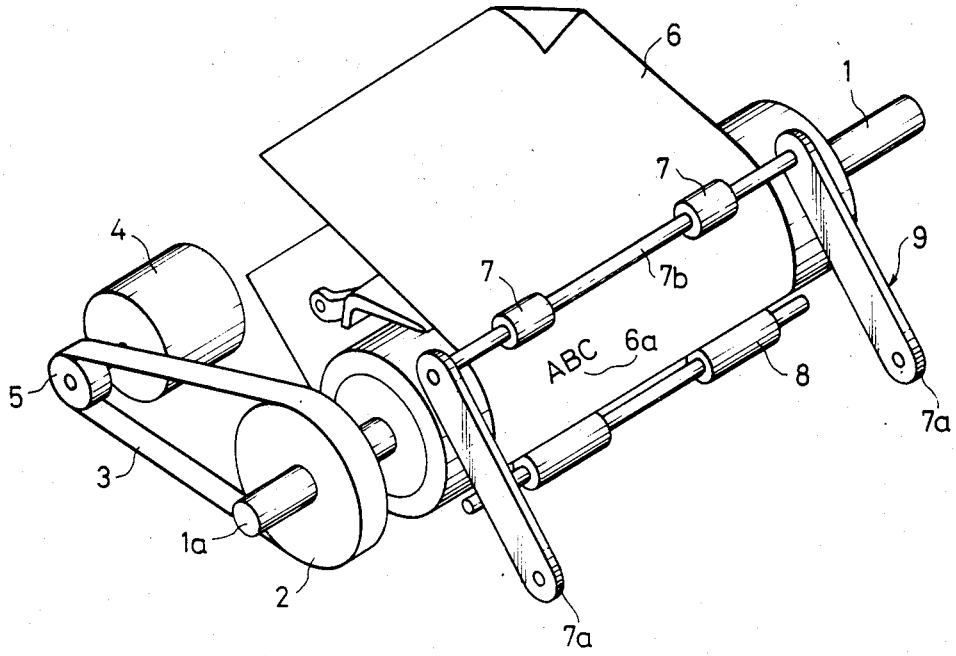
Figure 2:
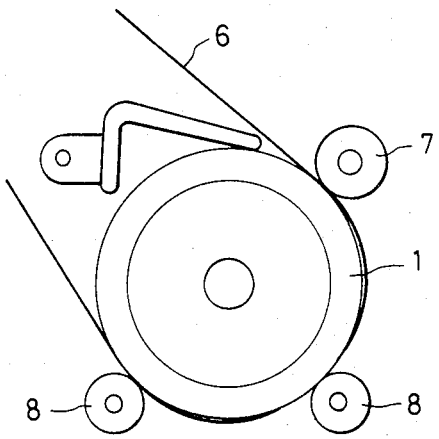
Figure 3:
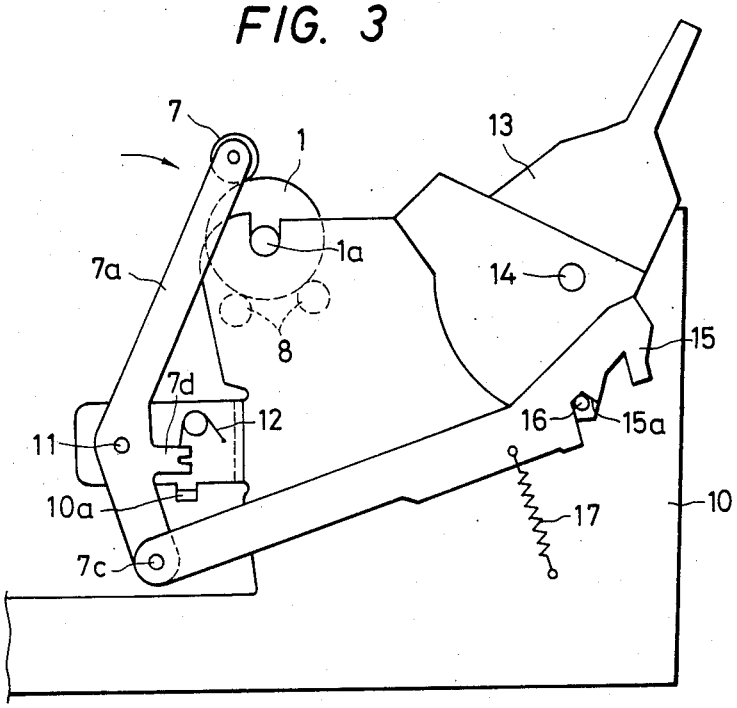
Figure 4:
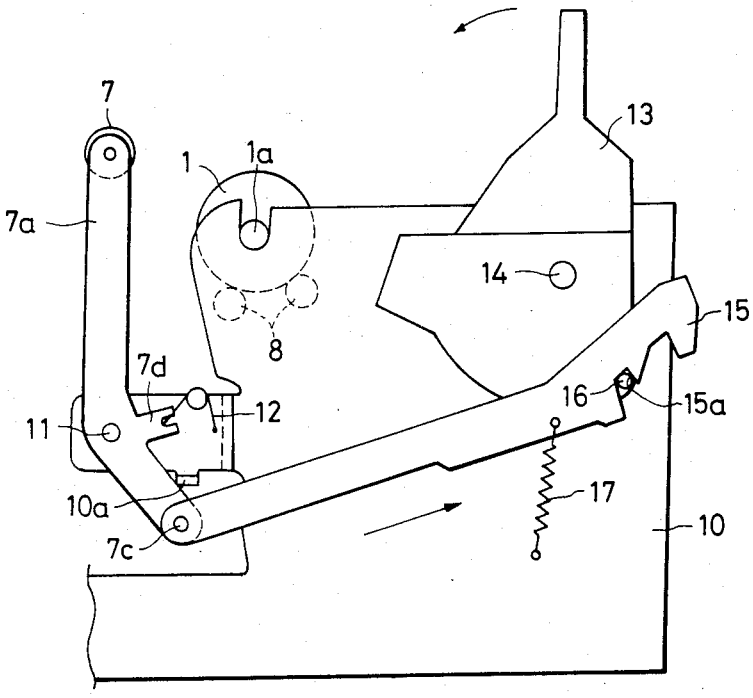
Figure 5:
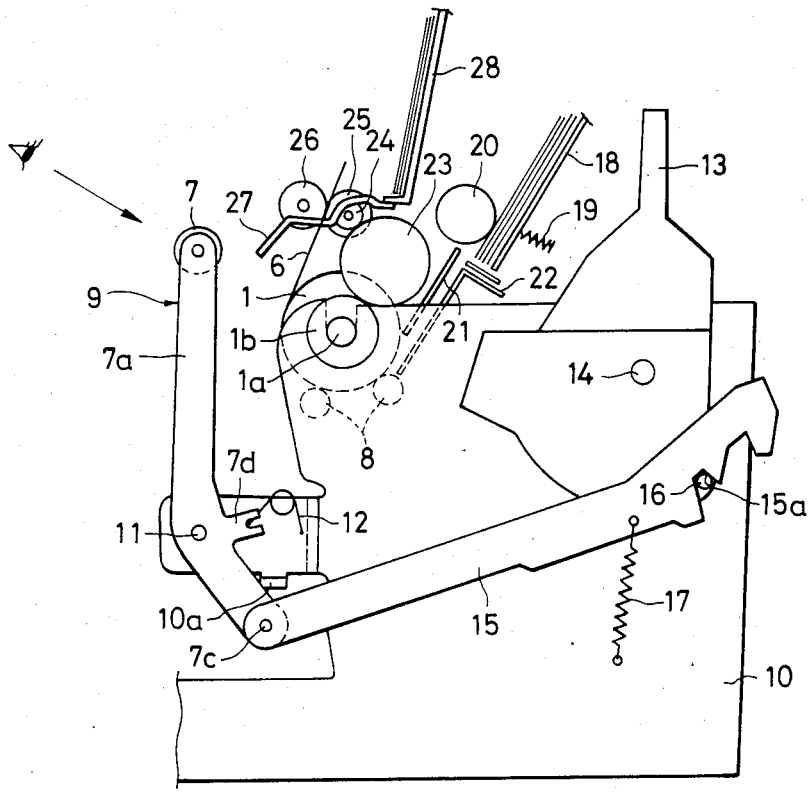
Figure 6:
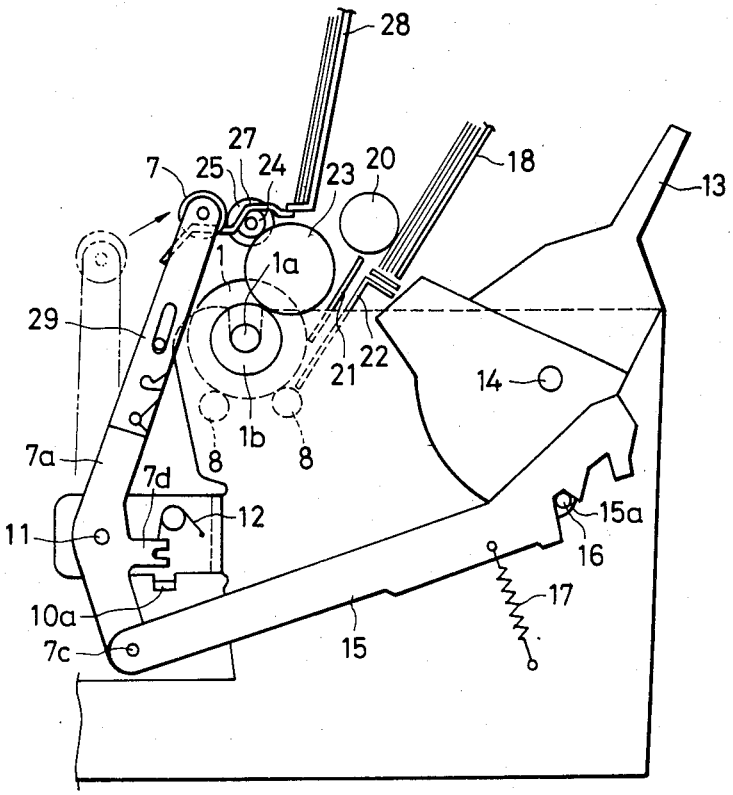
Figure 7:
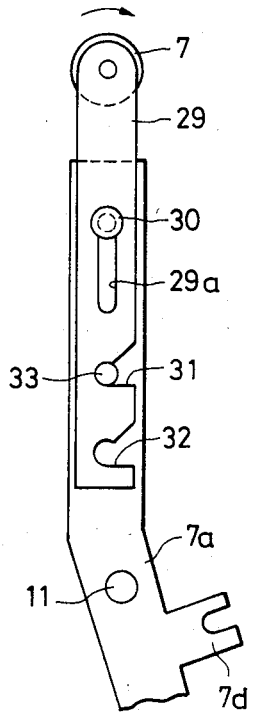
Figure 8:
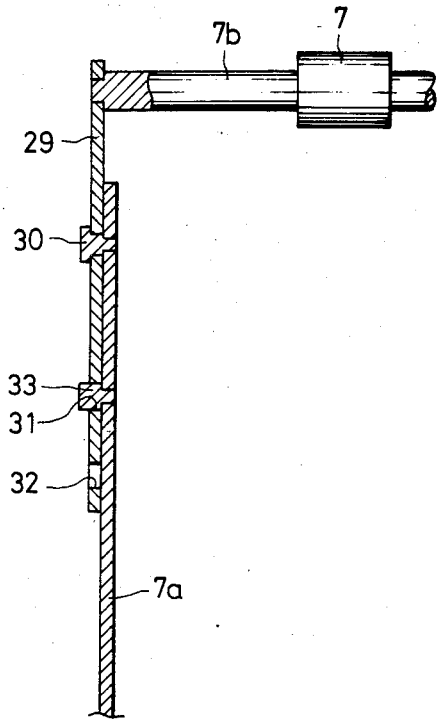

FIGS. 6 to 8 show one embodiment of the present invention in which the like elements to those shown in FIGS. 1 to 6 are designated by the like numerals and the explanation thereof is omitted.

In the present embodiment, slidable arms 29 are attached to ends of arms *7a*.

In the structure, the slidable arms expand in a direction crossing the swing direction of the arms *7a* and a roller 7 is movable in the crossing direction. Namely, a pinch roller 7 is rotatably mounted at an end of each slidable arm 29 which is an expandable member, by a shaft *7b*.

An axially extending slot 29*a* is formed in an intermediate portion of each slidable arm 29 and each slot 29*a* is slidably attached to the arm *7a* by a pin 30 fixed to the arms *7a*.

On the other hand, two notches 31 and 32 are formed vertically at a lower end of each slidable arm 29.

The notches 31 and 32 are of sector shape expanding toward an entry with a pin 33 projecting from the arms *7a* fitting to an inner portion.

In the present embodiment, when it is to be used as a normal paper bail, the slidable arms 29 descend to a position where each pin 30 contacts an upper end of its slot 29*a* and the each pin 33 is engaged with its upper notch 31.

Under this condition, the roller 7 is at a low position and it contacts to the platen 1 to allow the normal paper bail operation.

On the other hand, when the cut sheet feeder is mounted, the slidable arms 29 rotate clockwise around the pin 30 from the position shown in FIG. 7 as indicated by an arrow so that each pin 33 is moved off its notch 31 and the slidable arms 29 can be pulled upward. The pins 33 are then engaged with the lower notch 31 so that each slidable arm 29 is brought to a most expanded position.

Under this condition, the roller 7 contacts the paper ejection roller 25 as shown in FIG. 6 to serve as the pinch roller.

The counterclockwise force (as viewed in FIG. 7) may act when the roller 7 contacts the platen 1 or the ejection roller 25, but the rotation of each slidable arm 29 is prevented by its pin 33.

As described herein above, in accordance with the present embodiment, the arm of the paper bail is expandable so that the paper bail can be used either as the normal paper bail or the pinch roller and it does not block the view field of the operator.

What we claim is:

1. A sheet feeding mechanism comprising:

a main apparatus mechanism provided with a first rotating member for advancing a record sheet while the record sheet passes through a recording position; and an auxiliary mechanism removably mountable to said main apparatus mechanism, said auxiliary mechanism comprising feed means for feeding the record sheet to the first rotating member of the main apparatus mechanism and receiving means for receiving the record sheet having passed through thte first rotating member, said receiving means comprising a second rotating member which generates a force for further advancing the record sheet;

said main apparatus mechanism further comprising pressing means movable between a first position where the pressing means may be urged against said first rotating member to effect the advancement of the record sheet therebetween without a bulge of the record sheet, and a second position where the pressing means may be urged against said second rotating member to effect the further advancement of the record sheet therebetween by transmitting said force of the second rotating member onto the record sheet;

wherein said pressing means comprises a holding member having a first member pivotally mounted to a point so as to be able to swing around said point and a second member joined to said first member by joining means for allowing said second member to extend relative to said first member in a direction crossing the swing of the holding member, and a pinch roller rotatably supported at a swinging end of said holding member;

wherein said joining means comprises a plurality of notches on said second member, and a first projection on said first member removably inserted in one of said notches, and means for slidably affixing said first member relative to said second member to permit said second member to extend relative to said first member.

2. A sheet feed mechanism according to claim 1, wherein said first rotating member is a platen on which said record sheet is wrapped, and said second rotating member is a sheet ejection roller for feeding said record sheet fed by said platen to an ejected sheet stacker above said platen.

3. A sheet feed mechanism according to claim 2, wherein said platen and said sheet ejection roller are coupled through a motive force transmission member and rotated synchronously by the common drive source.

4. A sheet feed mechanism according to claim 2, wherein said platen is mounted on a recorder for making a record on the record sheet, and said sheet ejection roller is mounted on the auxiliary mechanism removably mounted on said main apparatus mechanism.

5. A sheet feed mechanism according to claim 1, wherein said means for slidably affixing said first member relative to said second member is a portion of one of said first and second members that defines a slot, and a second projection on the other of said first and second members that projects through said slot.

* * * * *